US011202134B2

(12) United States Patent
Han et al.

(10) Patent No.: US 11,202,134 B2
(45) Date of Patent: Dec. 14, 2021

(54) SPEAKER MODULE

(71) Applicant: GOERTEK INC., Weifang (CN)

(72) Inventors: Dan Han, Weifang (CN); Xinxiang Huo, Weifang (CN); Yun Yang, Weifang (CN)

(73) Assignee: GOERTEK INC., Weifang (CN)

( * ) Notice: Subject to any disclaimer, the term of this patent is extended or adjusted under 35 U.S.C. 154(b) by 778 days.

(21) Appl. No.: 16/080,856

(22) PCT Filed: May 18, 2016

(86) PCT No.: PCT/CN2016/082422
§ 371 (c)(1),
(2) Date: Aug. 29, 2018

(87) PCT Pub. No.: WO2017/148008
PCT Pub. Date: Sep. 8, 2017

(65) Prior Publication Data

US 2019/0098385 A1 Mar. 28, 2019

(30) Foreign Application Priority Data

Feb. 29, 2016 (CN) ..... 201610112352.5

(51) Int. Cl.
*H04R 25/00* (2006.01)
*H04R 1/02* (2006.01)
(Continued)

(52) U.S. Cl.
CPC ..... *H04R 1/023* (2013.01); *H04R 9/02* (2013.01); *H04R 9/06* (2013.01); *H04R 1/025* (2013.01);
(Continued)

(58) Field of Classification Search
CPC combination set(s) only.
See application file for complete search history.

(56) References Cited

U.S. PATENT DOCUMENTS

2014/0169579 A1* 6/2014 Azmi ..... G10K 11/17821 381/71.6

FOREIGN PATENT DOCUMENTS

CN 1856180 A 11/2006
CN 201718041 U 1/2011
(Continued)

*Primary Examiner* — Amir H Etesam
(74) *Attorney, Agent, or Firm* — Saliwankchik, Lloyd & Eisenschenk

(57) ABSTRACT

The present invention discloses a speaker module, comprising a housing and a speaker unit located in an inner cavity of the housing and dividing the inner cavity into a front acoustic cavity and a rear acoustic cavity separated from each other, wherein the housing is additionally provided with a pressure relief device configured to communicate the rear acoustic cavity with an external environment and implement an acoustic seal, the pressure relief device comprises a pressure relief hole extending through a thickness direction of the housing and provided with a gland on one side close to the rear acoustic cavity, and a pressure relief groove is disposed at a surface of the gland close to the pressure relief hole, one end of the pressure relief groove is connected with the pressure relief hole, the other end of the pressure relief groove is led out of an end of the gland, and the pressure relief groove and the pressure relief hole together make up a pressure relief passage of the rear acoustic cavity. The pressure relief grooves of the pressure relief devices of the speaker modules are arranged on the gland, which makes processing easier and can effectively improve the yield of the speaker module.

9 Claims, 3 Drawing Sheets

(51) Int. Cl.

| | |
|---|---|
| ***H04R 9/02*** | (2006.01) |
| ***H04R 9/06*** | (2006.01) |
| *H04R 1/28* | (2006.01) |

(52) U.S. Cl.
CPC ..... *H04R 1/2849* (2013.01); *H04R 2201/029* (2013.01); *H04R 2499/11* (2013.01)

(56) References Cited

FOREIGN PATENT DOCUMENTS

| | | | |
|---|---|---|---|
| CN | 204131710 | U | 1/2015 |
| CN | 204180228 | U | 2/2015 |
| CN | 204906708 | U | 12/2015 |
| CN | 105516870 | A | 4/2016 |
| CN | 205491108 | U | 8/2016 |
| CN | 205622852 | U | 10/2016 |
| EP | 0954200 | A2 | 11/1999 |
| EP | 1653767 | A3 | 11/2008 |

* cited by examiner

SPEAKER MODULE

CROSS REFERENCE TO RELATED APPLICATIONS

This application is a National Stage of International Application No. PCT/CN2016/082422, filed on May 18, 2016, which claims priority to Chinese Patent Application No. 201610112352.5, filed on Feb. 29, 2016, both of which are hereby incorporated by reference in their entireties.

FIELD OF THE INVENTION

The present invention relates to the field of acoustic energy conversion, and in particular, to a speaker module.

BACKGROUND OF THE INVENTION

In order to ensure that a micro speaker module can function normally under different air pressure environments, a rear acoustic cavity of a speaker is typically provided with a pressure relief device to ensure a balance with an ambient pressure.

An existing pressure relief device is generally designed so that a housing is provided with one pressure relief hole at a rear acoustic cavity and pressure relief grooves on one side close to the rear acoustic cavity, and one gland is affixed above the pressure relief grooves. The pressure relief grooves are in communication with the pressure relief hole to form a pressure relief passage that can render the rear acoustic cavity and an external environment isobaric and can achieve an acoustic seal effect. Disadvantages of such a design lie in a complicated shape of the housing, high requirements of injection molding, and limitations on the width and depth of the pressure relief grooves by molds.

SUMMARY OF THE INVENTION

One objective of the present invention is to provide a new technical solution of a speaker module.

According to a first aspect of the present invention, there is provided a speaker module. The module comprises a housing and a speaker unit located in an inner cavity of the housing and dividing the inner cavity into a front acoustic cavity and a rear acoustic cavity separated from each other, wherein the housing is additionally provided with a pressure relief device configured to communicate the rear acoustic cavity with an external environment and implement an acoustic seal, the pressure relief device comprises a pressure relief hole extending through a thickness direction of the housing and provided with a gland on one side close to the rear acoustic cavity, and a pressure relief groove is disposed at an end surface of the gland close to the pressure relief hole, one end of the pressure relief groove is connected with the pressure relief hole, the other end of the pressure relief groove is led out of an end of the gland, and the pressure relief groove and the pressure relief hole together make up a pressure relief passage of the rear acoustic cavity.

Preferably, the pressure relief device is disposed on a separator configured to separate the front acoustic cavity from the rear acoustic cavity in the housing.

Preferably, a plurality of pressure relief grooves are disposed on the gland.

Preferably, the housing is provided with a plurality of pressure relief devices.

Preferably, a cross section of the pressure relief groove is rectangular, arc-shaped or triangular.

Preferably, the cross section of the pressure relief groove is rectangular, the width and depth of the pressure relief grooves are less than or equal to 0.2 mm, respectively, and a length of the pressure relief grooves is greater than or equal to 2.0 mm.

Preferably, the pressure relief groove is linear, zigzag-shaped or curvilinear.

Preferably, the pressure relief hole is provided with a mesh on the other side away from the rear acoustic cavity.

Preferably, the mesh is a waterproof and air-permeable mesh.

The inventor of the present invention finds that in the prior art, pressure relief grooves are all arranged on a housing with higher requirements of processing technology of the housing, which will thus result in a low yield of a speaker module and limitations on the width and depth of the pressure relief grooves by molds. Therefore, the technical task to be accomplished or the technical problem to be resolved in the present invention has never been conceived of or anticipated by a person skilled in the art, and therefore the present invention is a new technical solution.

The speaker module provided in the present invention is provided with pressure relief devices that can effectively balance the air pressure of the rear acoustic cavity and the external environment. The pressure relief grooves of the pressure relief devices are arranged on the gland, which makes processing easier and can effectively improve the yield of the speaker module.

In addition, arranging pressure relief grooves on a gland is simple for processing, and the size of the pressure relief grooves can be set as needed.

Other features and advantages of the present invention will become apparent from the following detailed description of exemplary embodiments of the present invention with reference to the accompanying drawings.

BRIEF DESCRIPTION OF THE DRAWINGS

The accompanying drawings, which are incorporated in and constitute a part of the description, illustrate embodiments of the present invention and, together with the description thereof, serve to explain the principles of the present invention.

DETAILED DESCRIPTION OF THE EMBODIMENTS

Figure 1:
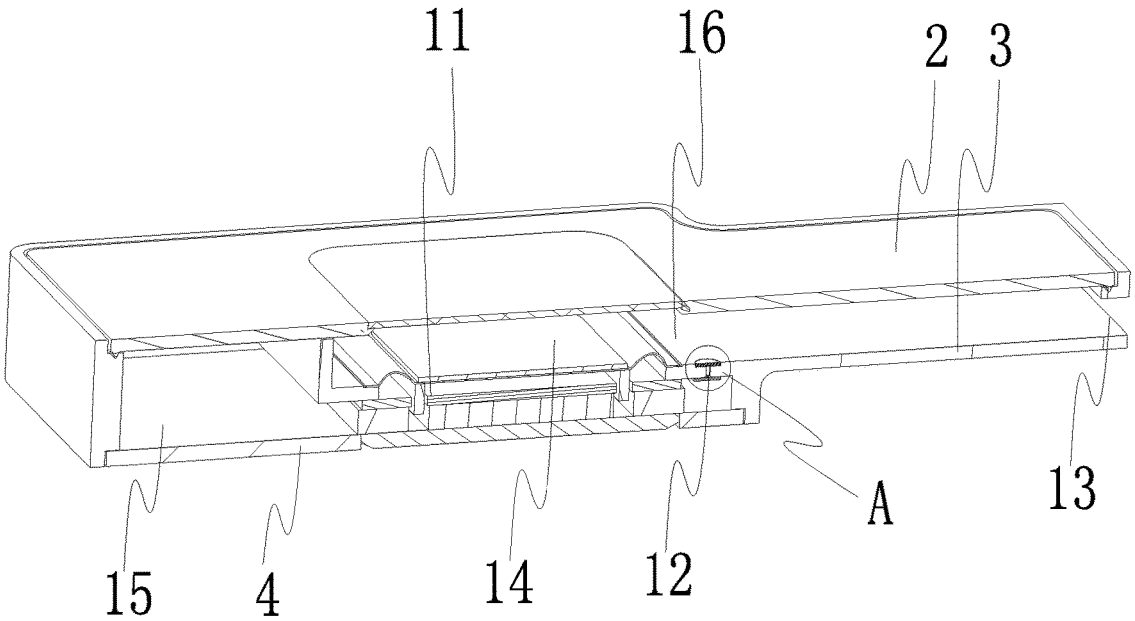
FIG. 1 is a sectional view of a speaker module of the embodiment of the present invention.

Various exemplary embodiments of the present invention will now be described in detail with reference to the accompanying drawings. It should be noted that the relative arrangement, numerical expressions and numerical values of the components and steps set forth in these examples do not limit the scope of the present invention unless otherwise specified.

The following description of at least one exemplary embodiment is in fact merely illustrative and is in no way intended as a limitation to the present invention and its application or use.

Techniques, methods, and apparatus known to those of ordinary skill in the relevant art may not be discussed in detail but where appropriate, the techniques, methods, and apparatus should be considered as part of the description.

Among all the examples shown and discussed herein, any specific value should be construed as merely illustrative and not as a limitation. Thus, other examples of exemplary embodiments may have different values.

It should be noted that similar reference numerals and letters denote similar items in the accompanying drawings, and therefore, once an item is defined in a drawing, and there is no need for further discussion in the subsequent accompanying drawings.

Figure 2:
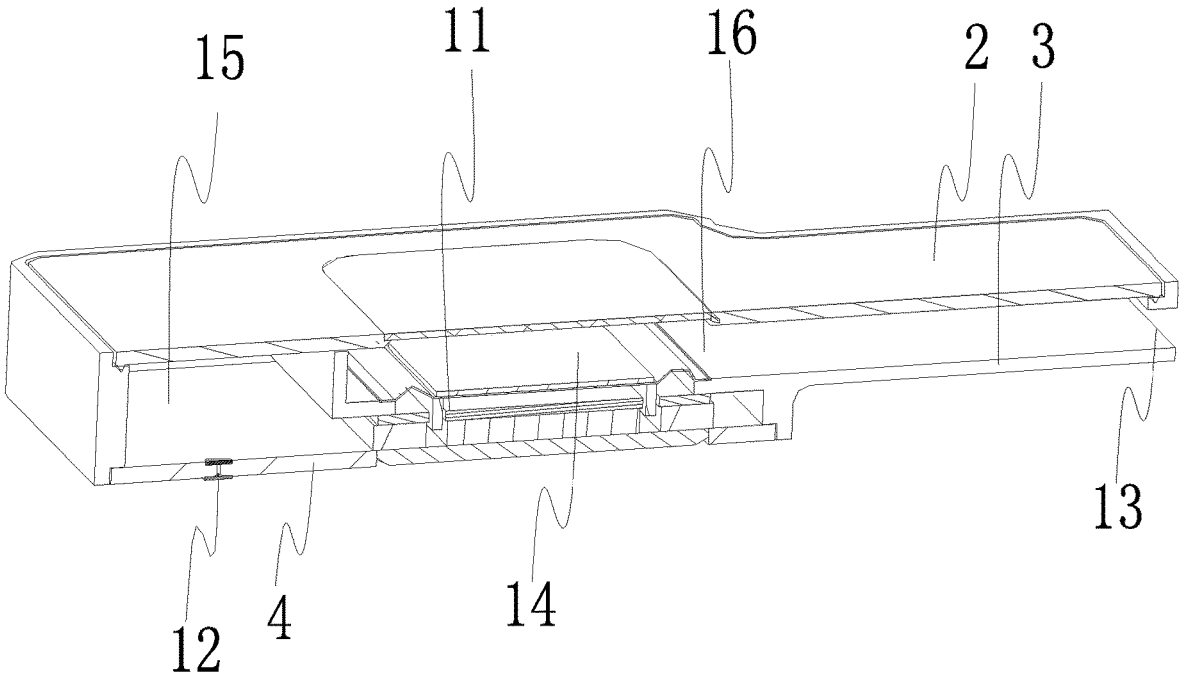
FIG. 2 is a sectional view of another speaker module of the embodiment of the present invention.
Figure 3:
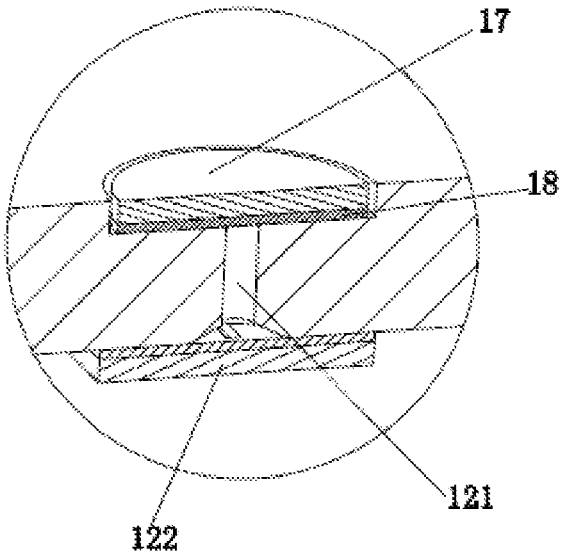
FIG. 3 is a partial enlarged view at A in FIG. 1.

The present invention provides a speaker module. Referring to FIGS. 1-3, the speaker module comprises a housing and a speaker unit 11. An upper housing 2, an intermediate housing 3 and a lower housing 4 make up the housing by way of snap-fit. An inner cavity where the speaker unit 11 is accommodated is formed in the housing. The speaker unit 11 divides the inner cavity into a front acoustic cavity 14 and a rear acoustic cavity 15 separated from each other. The front acoustic cavity 14 is indicative of a space between the vibration component of the speaker unit 11 and the upper housing 2, and is in communication with an external environment. The rear acoustic cavity 15 is indicative of a space between the magnetic circuit component of the speaker unit 11 and the lower housing 4, and is a sealed space. The housing is additionally provided with a pressure relief device 12 configured to communicate the rear acoustic cavity 15 with an external environment and implement an acoustic seal. The pressure relief device 12 comprises a pressure relief hole 121 extending through a thickness direction of the housing and provided with a gland 122 at an end surface close to the rear acoustic cavity 15. The gland 122 is provided with a pressure relief groove 1221 on one side close to the pressure relief hole 121, one end of the pressure relief groove 1221 is connected with the pressure relief hole 121, and the other end thereof is led out of an end of the gland 122. The pressure relief groove 1221 and the pressure relief hole 121 together make up a pressure relief passage of the rear acoustic cavity 15, which communicates the rear acoustic cavity 15 with the external environment. Air can pass through the pressure relief passage, and the pressure in the rear acoustic cavity 15 is maintained consistent with the external environment pressure. Also, the pressure relief grooves 1221 of the pressure relief devices 12 are arranged on the gland, rather than on the housing. This design significantly reduces the processing difficulty for the housing, and improves the yield of the housing. In addition, the technology of processing the pressure relief grooves 1221 on the gland 122 is relatively simple with a high yield of the gland 122, and therefore, this design can effectively improve the yield of the speaker module.

The speaker unit comprises a magnetic circuit system and a vibration system. The magnetic circuit system comprises a frame positioned in the inner cavity and a magnet positioned in the frame, the magnet and a side wall of the frame have a gap therebetween, and the magnet is also provided with a washer, etc. The vibration system comprises a vibration diaphragm fixed in the inner cavity and a voice coil for driving the vibration diaphragm to produce sounds, the voice coil is fixed on the vibration diaphragm and suspended in the gap between the magnet and the side wall of the frame, and a dome is provided at the center position of the vibration diaphragm.

The voice coil can vibrate under the effect of the magnetic circuit system after being energized, and drives the vibration diaphragm to vibrate together, in this way, the vibration diaphragm produces sounds. The housing is additionally provided with sound holes 13 in communication with the front acoustic cavity 14 so that the sounds produced by the vibration diaphragm can be transmitted from the sound holes 13 to the outside. The structure will be falling within the common knowledge of a person skilled in the art, and thus not repeated in detail herein.

It should be noted that the pressure relief passage is acoustically sealed. For a person skilled in the art, the acoustic seal means an acoustically sealed state. That is to say, sound waves are not allowed to pass through. The pressure relief passage is acoustically sealed, or the sounds in the front acoustic cavity 14 cannot be transmitted through the pressure relief passage into the rear acoustic cavity 15, so that acoustic insulation between the front acoustic cavity 14 and the rear acoustic cavity 15 can be ensured to prevent a failure in speakers due to an acoustic short circuit.

In some embodiments, the acoustic seal of the pressure relief passage can be implemented by means well known to a person skilled in the art, such as, miniaturizing the pressure relief passage, or improving a damping of the pressure relief passage by adopting other well known means so that the pressure relief passage becomes a damping hole structure and hence can prevent sounds from being propagated in the pressure relief passage.

Figure 4:
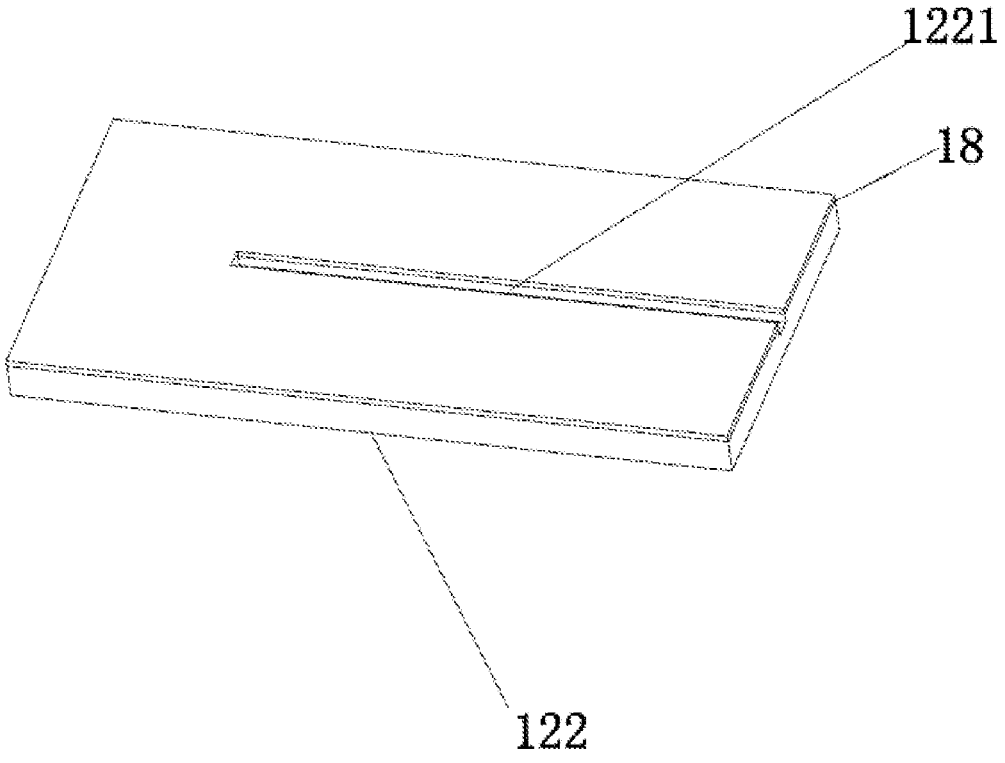
FIG. 4 is a schematic view of a gland of the embodiment of the present invention.

Referring to FIGS. 1-2, in an embodiment of the present invention, the pressure relief hole 121 is provided with the gland 122 on one side close to the rear acoustic cavity 15. In practice, as shown in FIG. 4, the gland 122 can be fixed by bonding a double-sided adhesive tape 18 to the housing; and a mesh 17 is provided on one side away from the rear acoustic cavity 15. To be specific, as shown in FIG. 3, the mesh 17 can also be adhesively fixed on the housing by the double-sided adhesive tape 18, so that the mesh can cover the pressure relief hole 121. The mesh 17 is air-permeable and can play a role of damping, so as to achieve the acoustic seal effect. Certainly, for a person skilled in the art, adjusting a magnitude of distance of cells in the mesh 17 can achieve a purpose of adjusting the damping. In the present invention, providing the mesh 17 can also prevent foreign materials from entering the rear acoustic cavity 15. More preferably, use of a waterproof mesh improves a waterproof performance of the speaker module, so that the speaker module is more suitable for a waterproof portable device.

Referring to FIG. 1, in a preferred embodiment of the present invention, the intermediate housing 3 is provided with a separator 16 configured to separate the front acoustic cavity 14 from the rear acoustic cavity 15. The separator 16 is provided with through holes used for mounting the speaker unit 11, and the pressure relief devices 12 of the module is disposed on the separator 16. A person skilled in the art will understand that the front acoustic cavity 14 is in communication with the external environment via the sound holes 13. Therefore, communicating the rear acoustic cavity 15 with the front acoustic cavity 14 is equivalent to communicating the rear acoustic cavity 15 with the external environment. It will be understood that the mesh 17 is covered on one side of the pressure relief hole 121 close to the front acoustic cavity 14, and the gland is mounted on one side close to the rear acoustic cavity 15. The speaker module, of which the pressure relief devices 12 are disposed inside the housing, does not separately provide a pressure relief passage in communication with the external environment in other locations of the rear acoustic cavity 15, so that the entire speaker module is clean and tidy in appearance, and hence a problem of damage to or clogging of the pressure relief devices 12 will not occur.

Materials of the upper housing 2, the intermediate housing 3 and the lower housing 4 are generally plastics, plastic cements or silica gels, and can be molded according to predetermined molds in an injection molding process. Components, such as the pressure relief hole 121, the separator 16 and the like, can be integrally formed in the process of injection molding. It is of course also possible to arrange the pressure relief hole 121 in the predetermined position after the housing is formed. Further, the shape of the cross-sectional area of the pressure relief hole 121 can be, but is not limited to, a circle, a rectangle, a triangle or the like. In order to improve the acoustic seal effect and guarantee the communication effect of the rear acoustic cavity 15 with the external environment, it is preferred that a cross section of the pressure relief hole 121 is circular. In order to reduce the difficulty of aligning the pressure relief hole 121 with the pressure relief grooves 1221, the pressure relief hole 121 is designed in a trumpet shape on one side close to the pressure relief grooves 1221. This structure increases communication areas of the pressure relief hole 121 and the pressure relief grooves 1221, and renders the communication of the pressure relief hole 121 with the pressure relief grooves 1221 more smooth.

The gland 122 generally has a sheet shape and can be designed in many other shapes as needed, such as rectangular, circular or the like, and its materials can be plastics, such as PE (polyethylene), PC (polycarbonate), PP (polypropylene), or the like. The gland 122 can be molded using one set of mold in an injection molding process. The pressure relief grooves 1221 are primarily formed during the injection molding process. After the gland 122 is formed, the pressure relief grooves 1221 can also be arranged on the surface of the gland by the technical means well known in the art. The gland 122 has a simple structure, and it is a simple process to arrange on its surface the pressure relief grooves 1221, which can be implemented according to a predetermined size. In use, the pressure relief grooves 1221 should be aligned with the pressure relief hole 121 to ensure that the pressure relief passage is unblocked, and the gland 122 can be adhered onto the pressure relief hole 121 in a manner, such as gluing around edges, using a double-sided adhesive tape or the like.

Figure 5:
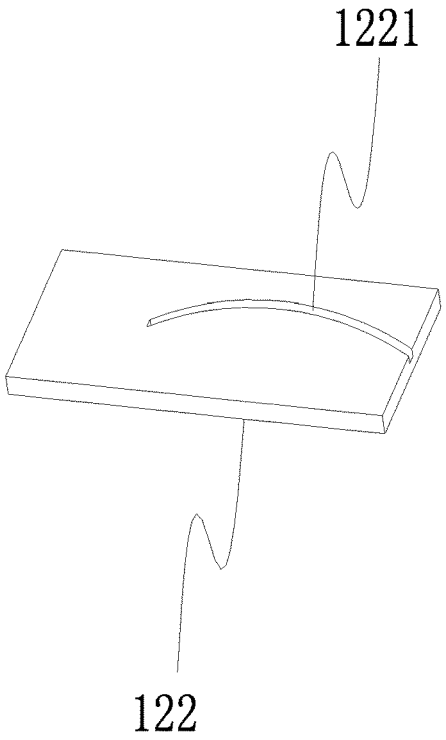
FIG. 5 is a schematic view of another gland of the embodiment of the present invention.
Figure 6:
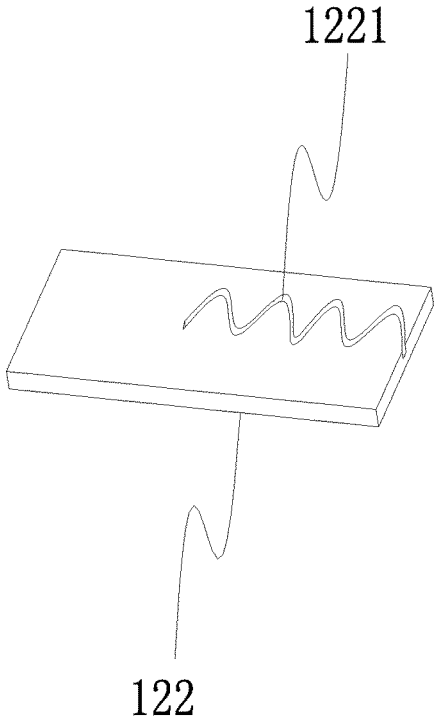
FIG. 6 is a schematic view of a further gland of the embodiment of the present invention.

Further, referring to FIGS. 4-6, the pressure relief groove 1221 can be designed in, but are not limited to, linear, zigzag-shaped or curvilinear. A linear pressure relief groove 1221 facilitates processing, and a zigzag-shaped or curvilinear pressure relief groove 1221 can increase a length of the pressure relief groove 1221 and achieve a better acoustic seal effect of the pressure relief devices. Furthermore, the shape of a cross section of the pressure relief grooves 1221 can be, but is not limited to, a circle, a rectangle, or a triangle, or the like, as long as it can achieve the effects of acoustic seal and air pressure balance and facilitate the processing. It should be noted that when the pressure relief grooves 1221 in the shapes shown in FIGS. 5 and 6 are used, the gland 122 itself can still be adhesively fixed with the housing by the double-sided adhesive tape 18. FIG. 4 has correspondingly illustrated this part, and thus the details will not be repeated herein.

A person skilled in the art will understand that the pressure relief grooves 1221 play a critical role in the effects of air pressure balance and acoustic seal on the rear acoustic cavity 15 and the external environment. The longer the pressure relief grooves 1221 and the smaller the inner diameter thereof, then the greater the acoustic resistance, and the smaller the amount of sound leakage, the better the acoustic seal effect, but the air pressure balance effect is undesirable. In contrast, the shorter the pressure relief grooves 1221 and the larger the inner diameter, then the smaller the acoustic resistance, the larger the amount of sound leakage, and the poorer the acoustic seal effect, but the air pressure balance effect is preferable.

In a specific embodiment of the present invention, in order to ensure good effects of air pressure balance and acoustic seal, the cross section of the pressure relief grooves 1221 is a rectangle, the width and depth of the pressure relief grooves 1221 are less than or equal to 0.2 mm, respectively, and the length of the pressure relief grooves 1221 is greater than or equal to 2.0 mm. Certainly, the size of the pressure relief grooves 1221 is not limited thereto, and a selection of the sizes should match the sizes and powers of speakers.

In order to ensure that the rear acoustic cavity 15 achieves an air pressure balance with the external environment, in a specific embodiment of the present invention, the gland 122 is provided with a plurality of the pressure relief grooves 1221 that can be radially distributed, i.e., the pressure relief grooves radiate from a center to an edge of a pressing plate and communicate with the pressure relief hole 121 at the center. The plurality of pressure relief grooves 1221 can also be distributed in parallel. Communications take place on one end where the communicated portion is in communication with the pressure relief grooves 1221. In another embodiment, the housing is provided with a plurality of pressure relief devices 12, which also can guarantee the air pressure balance. Arrangements of the plurality of pressure relief devices 12 can be chosen according to actual needs, which is not limited in the present invention.

While certain specific embodiments of the present invention have been illustrated by way of example, it will be understood by those skilled in the art that the foregoing examples are provided for the purpose of illustration and are not intended to limit the scope of the present invention. It will be understood by those skilled in the art that the foregoing embodiments may be modified without departing from the scope and spirit of the present invention. The scope of the present invention is subject to the attached claims.

What is claimed is:

1. A speaker module, comprising a housing and a speaker unit located in an inner cavity of the housing, wherein the speaker unit divides the inner cavity into a front acoustic cavity and a rear acoustic cavity separated from each other; and the housing is additionally provided with a pressure relief device configured to communicate the rear acoustic cavity with an external environment and implement an acoustic seal, the pressure relief device comprises a pressure relief hole extending through a thickness direction of the housing and provided with a gland on one side close to the rear acoustic cavity, a pressure relief groove is disposed at an end surface of the gland close to the pressure relief hole, one end of the pressure relief groove is connected with the pressure relief hole, the other end of the pressure relief groove is led out of an end of the gland, and the pressure relief groove and the pressure relief hole together make up a pressure relief passage of the rear acoustic cavity.

2. The speaker module according to claim 1, wherein the pressure relief device is disposed on a separator configured to separate the front acoustic cavity from the rear acoustic cavity in the housing.

3. The speaker module according to claim 1, wherein a plurality of pressure relief grooves is disposed on the gland.

4. The speaker module according to claim 1, wherein the housing is provided with a plurality of pressure relief devices.

5. The speaker module according to claim 1, wherein a cross section of the pressure relief grooves is rectangular, arc-shaped or triangular.

6. The speaker module according to claim 1, wherein the cross section of the pressure relief grooves is a rectangular, both the width and depth of the pressure relief grooves are less than or equal to 0.2 mm, respectively, and the length of the pressure relief grooves is greater than or equal to 2.0 mm.

7. The speaker module according to claim 1, wherein the pressure relief groove is linear, zigzag-shaped or curvilinear.

8. The speaker module according to claim 1, wherein the pressure relief hole is provided with a mesh on the other side away from the rear acoustic cavity.

9. The speaker module according to claim 8, wherein the mesh is a waterproof and air-permeable mesh.

* * * * *